US006508621B1

(12) United States Patent
Zeighami et al.

(10) Patent No.: US 6,508,621 B1
(45) Date of Patent: Jan. 21, 2003

(54) ENHANCED PERFORMANCE AIR MOVING ASSEMBLY

(75) Inventors: Roy M. Zeighami, Plano, TX (US); Christian L. Belady, McKinney, TX (US); Mike Devon Giraldo, Dallas, TX (US); Glenn C. Simon, Auburn, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/915,857

(22) Filed: Jul. 26, 2001

(51) Int. Cl.[7] ..... F04D 29/54
(52) U.S. Cl. ..... 415/119; 415/199.2; 415/211.2
(58) Field of Search ..... 415/199.1, 199.2, 415/198.1, 208.2, 211.2, 119

(56) References Cited

U.S. PATENT DOCUMENTS

| | | | | |
|---|---|---|---|---|
| 3,084,850 A | * | 4/1963 | Engalitcheff, Jr. | 415/193 |
| 4,219,325 A | * | 8/1980 | Gutzwiller | 415/192 |
| 5,246,339 A | * | 9/1993 | Bengtsson et al. | 415/208.1 |
| 5,927,944 A | | 7/1999 | Belady | 415/220 |
| 6,244,818 B1 | * | 6/2001 | Chang | 415/193 |

OTHER PUBLICATIONS

Web page, http://www.comairrotron.com/acfans.html, printed Jun. 21, 2001. Page entitled AC Blowers, AC Axial Fans, DC blowers, DC Axial Fans from Comair Rotron.

Web page, http://www.electronics.cooling.com/Resources/ED_Articles/May96/may96_01.htm., printed Jun. 21, 2001, "Electronics Cooling", Mike Turner, Comair Rotron (8 pages).

Seb page http://www.techniek.fontys.nl/ bka/ap/groepsproducten00/groep5/MickDoohan21.html, dated Jun. 21, 2001, (5 pages), entitled "Possibilites to increase static pressure by axial fans, making allowance for noise production" by M.G.W. van den Heuvel, Fontys University of Professional Education, Eindhoven, The Netherlands, Jan. 2000.

"Fan Handbook, Selection Application & Design", by Frank P. Bleier, McGraw Hill 1997, pp. 4.28 through 4.33.

Application Serial No. 09/867,194; filed May 29, 2001, inventor Christian Belady.

* cited by examiner

*Primary Examiner*—Ninh H. Nguyen

(57) ABSTRACT

The air moving assembly includes at least one air moving device and a stator, said stator being operable to at least reduce one expansion and/or one contraction for airflow passing through the assembly. The stator is also preferably operable to impart or adjust swirl for airflow passing through the stator. In at least one embodiment, the imparted or adjusted swirl rotates in a direction opposite to that of the rotation of an impeller of the air moving device. As a result, in at least one embodiment, airflow exiting the air assembly has no rotational component. The air moving assembly may include additional air moving devices and/or stators. In at least one embodiment, the air moving assembly includes first and second air moving assemblies coupled to a shared strut assembly.

17 Claims, 5 Drawing Sheets

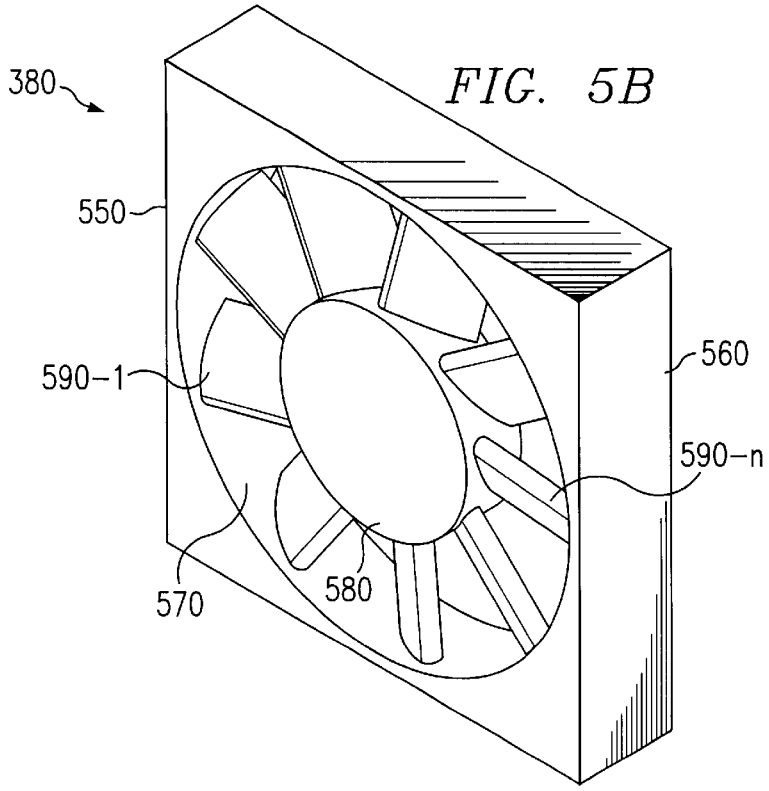
FIG. 5B
FIG. 5C
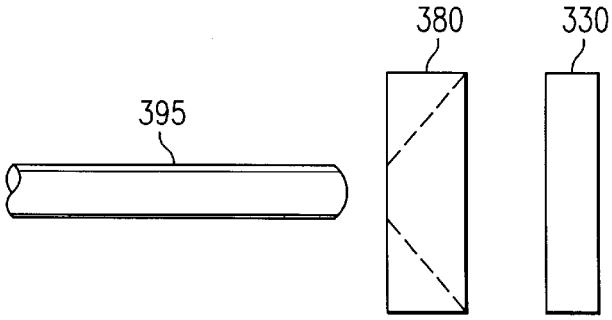
FIG. 5D
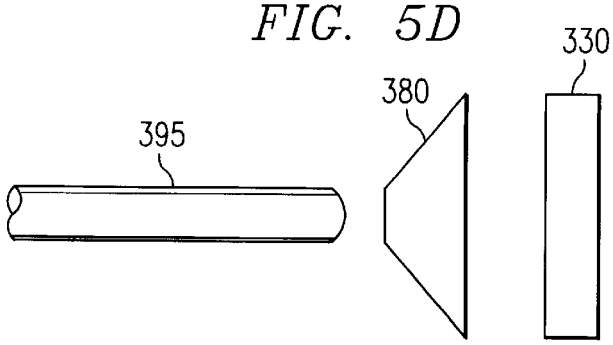

ENHANCED PERFORMANCE AIR MOVING ASSEMBLY

RELATED APPLICATION

This application is related to U.S. patent application Ser. No. 09/867,194 entitled, "ENHANCED PERFORMANCE FAN WITH THE USE OF WINGLETS" filed May 29, 2001, the disclosure of which is hereby incorporated by reference herein.

TECHNICAL FIELD

The present invention relates to systems and methods for aerodynamic flow, and more particularly to an enhanced performance air moving assembly and the components thereof.

BACKGROUND

Air moving devices such as fans and blowers are an important aspect of cooling systems, such as the cooling systems employed in today's electronic devices (e.g., computer devices such as central processing units (CPUs), storage devices, server devices, video cards). In the case of electronic devices, such air moving devices are typically used to push and/or draw air across heat sinks, as well as to remove waste heat from components of the electronic devices. Moreover, in addition to developing airflow through an electronic device, the fans, blowers, etc., must overcome system back pressure, which is the pressure lost due to aerodynamic resistance at the device. System back pressure depends upon such things as the number of heat sinks in the device, as well as the number of other components in the device.

Reliability is desired for the fans, blowers, etc., employed in the above mentioned cooling applications, especially for high end electronic devices, because when one fan fails, typically the remaining fans are unable to provide enough flow to compensate for the non-functioning fan. Unfortunately, these fans, etc., have high failure rates, most often on account of bearing failures. For this reason, most system designers employ N+1 fan configurations to compensate for the failure of a single fan. Examples of N+1 system designs are illustrated in FIGS. 1A and 1B.

N+1 configurations have two expected benefits. First, in N+1 configurations, if one fan fails, a redundant fan continues to push air through the system, thereby increasing the reliability of the cooling system. Secondly, for N+1 series configurations, particularly the configuration of FIG. 1B, if both the N and +1 fans are operating, theoretically, double the pressure should be provided by the two fans in series compared to that provided by a single fan (assuming the pressures are additive).

However, rarely, if ever, does the second expected benefit occur. One reason for this is that airflow exiting the first fan normally has some "swirl", meaning that the velocity of the airflow has a rotational component, as well as an axial component. This phenomena is illustrated in FIG. 2. As can be seen in FIG. 2, airflow entering fan 210 has a velocity represented in FIG. 2 by velocity vector 200. After passing through fan 210, velocity vector 200 develops both an axial component 220 and a rotational component 230. The swirl provided by first fan 210 normally degrades the performance of second fan 240. One reason for this is that typically the airflow exiting first fan 210 is swirling in the same direction as the rotation of the blades of second fan 240. As a result, the rotational speed of the blades of second fan 240 is effectively decreased.

In addition to the above, N+1 configurations have other notable disadvantages, to include the significant space required to implement N+1 configurations. Oftentimes, a desired design for an electronic device and/or cooling system does not leave adequate space for an N+1 configuration. As a result, cooling system designs and/or electronic device designs must be compromised to accommodate an N+1 configuration.

Another disadvantage of prior art air moving assemblies are losses due to the expansion and contraction of airflow as air passes through the assemblies.

Also included among the disadvantages of N+1 configurations is the fact that if one fan fails, the non-functioning fan creates a large impedance (i.e., airflow obstruction) in the cooling system. Therefore, two fans in series with one fan not working is worse for the cooling system then one fan by itself.

Another undesirable side effect of N+1 configurations is unwanted noise, to include acoustic beat frequencies.

SUMMARY OF THE INVENTION

The present invention is directed to an enhanced performance air moving assembly. In one embodiment, the air moving assembly includes a first air moving device (e.g., a fan, a blower) and a stator, the stator being operable to at least reduce one expansion and/or one contraction of airflow passing through the assembly. Preferably, the stator is also operable to impart to or adjust swirl for airflow passing through said stator. In at least one embodiment, the stator imparts or adjusts a certain swirl such that upon exiting the air moving assembly, the airflow has little or no swirl. Furthermore, various embodiments of the air moving assembly of the present invention include more than one air moving device and/or more than one stator. In at least one embodiment, the air moving assembly of the present invention is employed in cooling applications for electronic devices.

Moreover, in at least one embodiment, the air moving assembly includes a first air moving apparatus, as well as a second air moving apparatus, coupled to a strut assembly. In at least one of these embodiments, the strut assembly includes a stator operable to reverse the direction of swirl of the airflow exiting the first air moving apparatus.

It should be recognized that one technical advantage of one aspect of at least one embodiment of the present invention is that undesirable swirl normally hampering the efficiency of prior art air moving devices is counteracted, resulting in a higher performance air moving device. In addition, certain losses experienced in prior art systems, such as expansion and contraction losses, are reduced (and in some instances, eliminated) in various embodiments of the present invention. Moreover, in at least one embodiment of the present invention, valuable device space is saved by the sharing of components between air moving devices (e.g., shared strut assembly). Furthermore, in at least one embodiment, the air moving assembly of the present invention helps compensate for, at least in part, the impedance resulting from a non-functioning fan (i.e., the failed fan state). In addition, in at least one embodiment, acoustic beat frequencies are limited by the present invention.

BRIEF DESCRIPTION OF THE DRAWING

FIG. 5B depicts a second exemplary embodiment of a stator in accordance with the present invention;

FIG. 5C depicts a third exemplary embodiment of a stator in accordance with the present invention;

FIG. 5D depicts a fourth exemplary embodiment of a stator in accordance with the present invention.

DETAILED DESCRIPTION

Figure 1A:
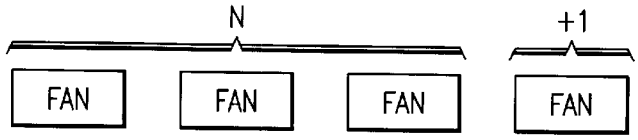
FIG. 1A (PRIOR ART)
FIG. 1A depicts an exemplary N+1 parallel fan system configuration.
Figure 1B:
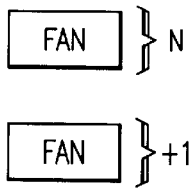
FIG. 1B (PRIOR ART)
FIG. 1B depicts an exemplary N+1 series fan system configuration.
Figure 2:
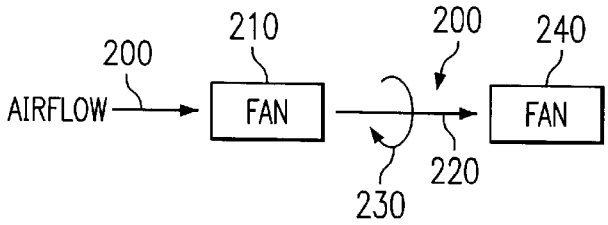
FIG. 2 (PRIOR ART)
FIG. 2 depicts the swirl phenomena experienced by airflow passing through an exemplary fan.
Figure 3A:
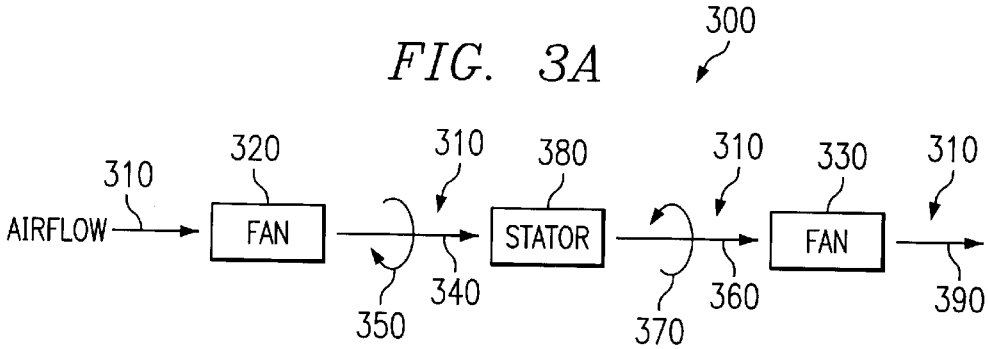
FIG. 3A depicts an exemplary embodiment of an air moving assembly in accordance with the present invention.

FIG. 3A depicts an exemplary embodiment of an air moving assembly of the present invention. In the embodiment of FIG. 3A, airflow having a certain velocity, represented by velocity vector 310 in FIG. 3A, passes through fan 320 of fan assembly 300. As a result of passing through fan 320, velocity vector 310 develops both an axial component 340 and a rotational component 350 (also referred to as "swirl" or radial velocity). In the embodiment of FIG. 3A, the blades of fan 320 rotate in a clockwise direction. Therefore, rotational component 350 is a clockwise rotational component.

At some point after passing through fan 320, the airflow passes through stator 380 and is altered. In a preferred embodiment, the direction of the rotational component is reversed. Accordingly, after passing through stator 380, velocity vector 310 of the airflow has an axial component 360 and a counter-clockwise rotational component 370.

After passing through stator 380, the airflow passes through fan 330. In the embodiment of FIG. 3A, the blades of fan 330 rotate in the same direction as that of fan 320. In a preferred embodiment, after passing through fan 330, the velocity of the airflow includes only axial component 390, i.e., possesses no rotational component. The removal of the rotational component of the airflow facilitated by the difference in the direction of rotation between the airflow entering fan 330 and the blades of fan 330 is desirable, at least in part, because by removing the rotational component, the kinetic energy associated with the swirl is converted into potential energy in terms of a desired increase in pressure.

Figure 3B:
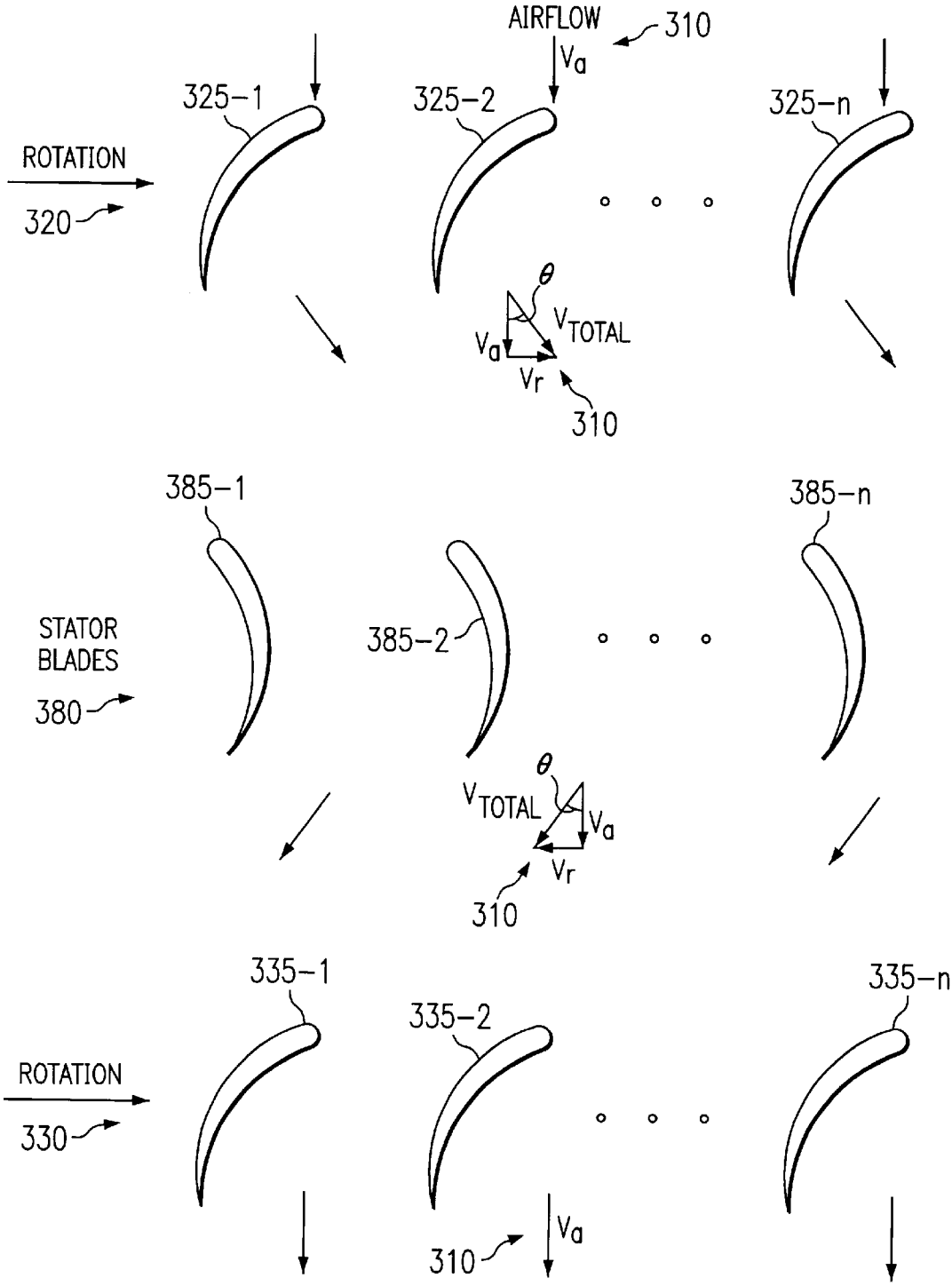
FIG. 3B depicts the alterations experienced by airflow passing through the air moving assembly of FIG. 3A.

FIG. 3B provides a top-down perspective of the effects of fans 320 and 330, as well as stator 380, on airflow passing through assembly 300. In FIG. 3B, airflow entering fan 320 has a velocity represented by velocity vector 310. As can be seen, upon entering fan 320, the velocity of the airflow has only axial component $V_a$. However, while the airflow passes through fan 320, rotating blades 325-1, 325-2, and 325-n (representing the blades of fan 320) deflect the airflow into a helical motion thereby accelerating the velocity such that when the airflow exits the blades of fan 320, the velocity of the airflow has increased from $V_a$ to $V_{total}$. $V_{total}$ includes axial component $V_a$, as well as a rotational component ($V_r$) and a given swirl angle (angle θ) (swirl angle being the angle of rotation of the airflow). As shown, blades 325-1, 325-2, and 325-n (representing the blades of fan 320) rotate in a clockwise direction. Therefore, in the embodiment of FIG. 3B, $V_r$ has a clockwise direction.

At some point after exiting the blades of fan 320, the airflow passes through stator 380, as a result of which , $V_r$ for the airflow is altered. In particular, while passing through stator 380, the airflow follows the contour lines of stator blades 385-1, 385-2, and 385-n (representing the stator blades of stator 380) such that when the airflow exits stator 380, the direction of $V_r$ is reversed.

In the embodiment of FIG. 3B, after exiting stator 380, the airflow passes through blades 335-1, 335-2, and 335-n (representing the blades of fan 330). As can be seen, blades 335-1, 335-2, and 335-n rotate in a clockwise direction. Therefore, the rotation of the blades of fan 330 deflect the airflow back into a more or less axial direction thereby decreasing the air velocity from $V_{total}$ to $V_a$ (i.e., the airflow exits the blades of fan 330 having only an axial component). As discussed earlier, although the velocity of the airflow is decreased, the total pressure is increased.

Referring back to FIG. 3A, fans 320 and 330 may be any one of several fans or other air moving devices, now known or later developed, to include a propeller fan, tube axial fan, vane axial fan, centrifugal fan, axial-flow fan, forward curved wheel blower, backward curved wheel blower, squirrel cage blower, and the like. In at least one embodiment of fan assembly 300, the structure of fan 330 is identical to that of fan 320 However, it will be appreciated that the structure of fan 330 may be different from that of fan 320.

Figure 4:
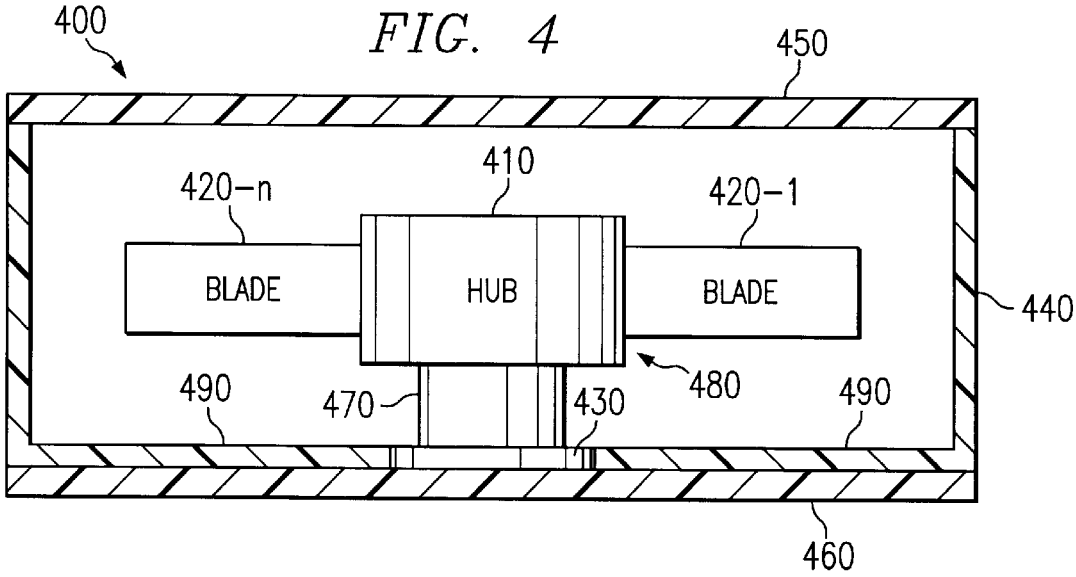
FIG. 4 depicts an exemplary embodiment of a fan that may be employed in the fan assembly of FIG. 3A.

FIG. 4 depicts an exemplary embodiment of fan 400 that may be employed as fan 320 and/or fan 330. Fan 400 includes motor assembly 470. Coupled to motor assembly 470 is impeller 480. In at least one embodiment, impeller 480 includes hub 410 and one or more blades integrated therewith or attached thereto (the one or more blades represented by blades 420-1 and 420-n in FIG. 4). In at least one embodiment, assembly 470, along with impeller 480, is disposed within, and, preferably, secured to base 440 that includes an open interior region spanned by struts 490. Struts 490 support a central location 430 to which assembly 470, as well as impeller 480, are mounted. In at least one embodiment, base 440 further includes stationary venturi (not shown) having an inner surface that, in a known manner, typically resembles an airfoil rotationally symmetric about hub 410, which is closely spaced radially beyond the distal ends of rotating blades 420-1 and 420-n. Moreover, preferably, attached to or integrated with base 440 is first finger guard 450 and second finger guard 460. Furthermore, blades 420-1 and 420-n may include winglets as discussed in U.S. patent application Ser. No. 09/867,194, previously incorporated by reference herein.

Figure 5A:
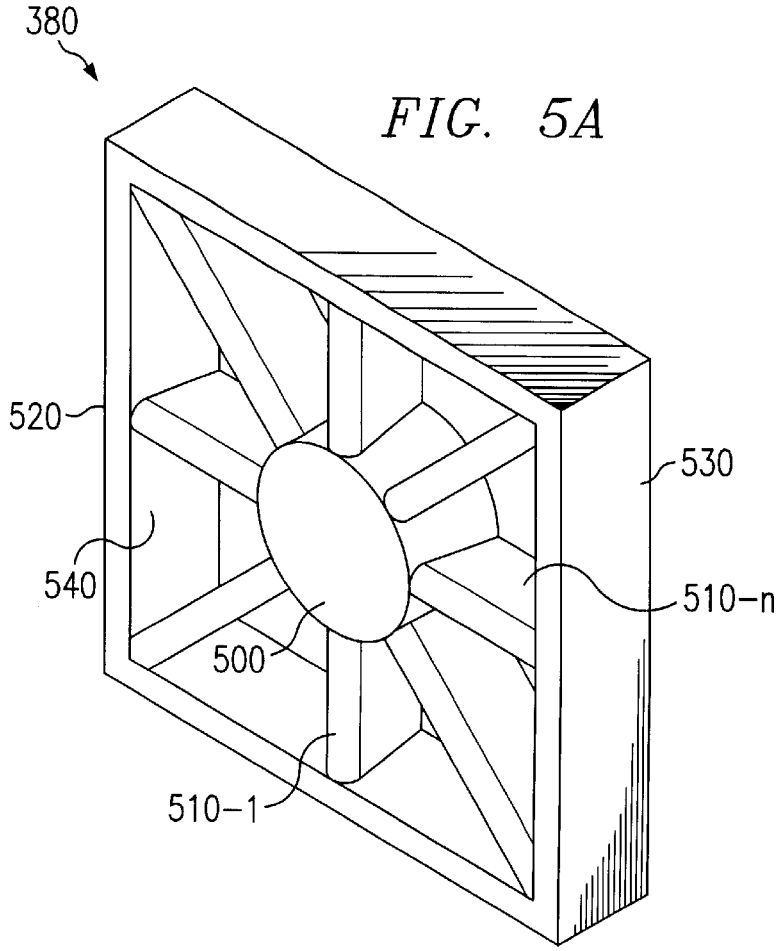
FIG. 5A depicts a first exemplary embodiment of a stator in accordance with the present invention.

FIGS. 5A and 5B depict exemplary embodiments of stator 380. In the embodiment of FIG. 5A, stator 380 includes frame 520, which itself includes rectangular outer surface 530 and rectangular inner surface 540. Also included in the embodiment of FIG. 5A is stator hub 500. Coupled to hub 500 and frame 520 (e.g., integrated therewith) are one or more stator blades (also referred to as guide vanes), such as blades 510-1 and 510-n. Hub 500 and blades 510-1 and 510-n are stationary, i.e, do not rotate around the center axis of hub 500. Furthermore, the stator blades are straight blades, meaning the chord line for each of the blades is straight (chord line being the line joining the centers of the leading edge and trailing edge of the blade). In at least one embodiment, one or more of the edges of blades 510-1 and 510-n are rounded to improve aerodynamics. Moreover, in at least one embodiment, the stator blades have an airfoil shape.

In the embodiment of FIG. 5B, similar to FIG. 5A, stator 380 includes frame 550. However, unlike frame 520, frame 550 includes rectangular outer surface 560 and circular inner surface 570. Also included in stator 380 in FIG. 5B is stator hub 580. Coupled to and/or integrated with hub 580 and frame 550 are one or more stator blades, such as blades 590-1 and 590-n. Hub 580 and blades 590-1 and 590-n are stationary, i.e., do not rotate around the center axis of hub 580. Moreover, unlike the stator of FIG. 5A, the stator blades of FIG. 5B are curved blades, meaning the chord lines for the blades are curved. stator blades of FIG. 5B are curved blades, meaning the chord lines for the blades are curved.

In at least one embodiment, stator 380 is operable to at least reduce (preferably eliminate) one expansion and/or one contraction of air flow passing through assembly 300. In one embodiment, stator 380 at least reduces (preferably eliminates) one expansion and/or one contraction by virtue of having a surface whose annular area matches that of a surface(s) of fan 320 and/or fan 330. In addition, in at least one embodiment, the annular area of the hub of stator 380 is matched to that of the hub of fan 320 and/or fan 330 to reduce or preferably eliminate expansion and/or contraction as well. Moreover, in at least one embodiment, the thickness of stator 380 is on the same order as that of fans 320 and 330.

In addition, in at least one embodiment, the annular area of a first surface of stator 380 matches that of a surface of one component of assembly 300, while the annular area of a second surface of stator 380 matches that of a surface of another component of assembly 300, the surface of the later described component having an annular area different from that of the surface of the earlier described component. For example, FIG. 5C depicts a side-view of an embodiment of stator 380 disposed between fan 330 and air duct 395. Fan 330 may be at the inlet or outlet of duct 395. As can be seen, the annular area of at least one surface of fan 330 is different from that of at least one surface of air duct 395. To reduce (preferably, eliminate) at least one expansion and/or one contraction of the airflow passing through assembly 300, the annular area of at least one surface of stator 380 matches that of fan 330, while the annular area of at least another surface of stator 380 matches that of air duct 395. As part of this matching, in the embodiment of FIG. 5C, the inner surface of stator 380 tapers from the annular area of a surface of fan 330 to the annular area of a surface of air duct 395. In the embodiment of FIG. 5D, not only is an inner surface of stator 380 tapered, but an outer surface is as well. The stator blades of stator 380 (not shown in FIGS. 5C and 5D) are disposed somewhere within the interior region spanned by the tapered interior surface. Although in FIGS. 5C and 5D the inner surface of stator 380 tapers from the annular area of a surface of a component to the right of fan 330 to that of a surface of a component to its left, it will be appreciated that in some embodiments, the opposite is true.

Preferably, the number of stator blades included in stator 380 is greater than the number of fan blades included in fan 320 and/or fan 330. The preferred number of blades for a particular embodiment of stator 380 depends upon the desired effect of stator 380 on the airflow passing therethrough. One way to determine the preferred number of blades is to experiment with the number of blades until the desired effect is achieved.

Similarly, the blade angle for one or more of the blades of stator 380 depends upon the desired effect of an embodiment of stator 380 on the airflow passing therethrough (blade angle being the angle between the chord line of a blade and the plane of the axial direction of the airflow). For example, as discussed above, for at least one embodiment, it is desired that stator 380 reverses the direction of the rotational component of the velocity of the airflow passing therethrough. Therefore, in such an embodiment, the preferred blade angle for one or more blades of stator 380 is the blade angle which facilitates the reversal of the direction of the rotational component.

The suitable blade angle(s) to accomplish the above may be determined in more than one manner. As non-limiting examples, the appropriate blade angle(s) to facilitate the desired effect of stator 380 upon the airflow may be determined: through experimental measurement (which may include computer simulation) of the airflow exiting stator 380 and/or fan assembly 300 for various iterations of the blade angles of the blades of stator 380; through experimental measurement (which may include computer simulation) of a mechanical mockup of fan assembly 300; through calculation of the blade angle using airflow network methods; and/or calculation of the blade angle using computational fluid dynamics software. In one embodiment, as part of one or more of the above methods or a different method altogether, the swirl angle of the air flow entering stator 380 is determined using the following formulae:

$$\text{axial velocity}=\text{volumetric flow rate } (f^3/\text{m})/\text{area } (f^2)$$

$$\text{radial velocity}=(233\times10^5)\times(\text{static pressure (inches of water column)})/(\text{speed of fan (rpm)})\times(\text{radius of fan blade})$$

$$\text{swirl angle}=\tan^{-1}[\text{radial velocity}/\text{axial velocity}]$$

The swirl angle may then be used to determine suitable blade angles for achieving the desired effect on the rotational component. Moreover, in at least one embodiment, determining the desired blade angle(s) involves, at least in part, determination of the operating point of fan 320 and/or fan 330.

Moreover, the curvature of one or more of the blades of stator 380 depends upon the desired effect of an embodiment of stator 380 on the airflow passing therethrough. As mentioned, for at least one embodiment, it is desired that stator 380 reverses the direction of the rotational component of the velocity of the airflow passing therethrough. Therefore, in such an embodiment, the preferred curvature for one or more blades of stator 380 is the curvature which facilitates the reversal of the direction of the rotational component.

Furthermore, similar to earlier discussions, suitable curvature for one or more blades of stator 380 may be determined: through experimental measurement (which may include computer simulation) of the airflow exiting stator 380 and/or fan assembly 300 for various iterations of the curvature of one or more blades of stator 380; through experimental measurement (which may include computer simulation) of a mechanical mockup of fan assembly 300; through calculation of curvature using airflow network methods; and/or calculation of the curvature using computational fluid dynamics software. Furthermore, in at least one embodiment, the curvature of the blades of stator 380 are matched to the swirl angle of the airflow exiting fan 320 in order to produce the desired effect.

In one embodiment, stator 380 is fabricated from sheet metal. In an alternative embodiment, stator 380 is formed via injection molding. In one of these embodiments, the frame, hub, and blades are formed as separate parts and than coupled together. In another embodiment, the frame, hub, and blades are formed as one piece. In at least one embodiment, stator 380 may be formed from some combination of the above.

In at least one embodiment, stator 380 is a drop-in module that may be inserted between two fans of an N+1 series fan configuration so as to increase the performance of an N+1 series fan configuration. Moreover, in at least one embodiment, stator 380 may be employed with (e.g, coupled to or inserted before or after) a known air moving device to increase the performance of the device. For example, stator 380 may be employed with a tube axial fan to effectively create a vane axial fan.

It will be appreciated that the configurations of stator 380 depicted in FIGS. 5A and 5B are by way of example only, for stator 380 may have numerous other configurations. For example, frame 520 may have a circular inner surface. Similarly, frame 550 may have a rectangular inner surface. Moreover, frame 520 and/or frame 550 may have both a circular outer surface and circular inner surface, or some shape other than a rectangle or circle. In addition, rather than being implemented as a hub-and-blade configuration, as depicted in FIGS. 5A and 5B, stator 380 may instead have a honeycomb configuration.

Not only are the configurations of stator 380 depicted in FIGS. 5A and 5B by way of example only, but the configuration of fan assembly 300 depicted in FIG. 3A is as well, for fan assembly 300 may have several configurations. For example, fan assembly 300 may include a greater number of fans and stators than that depicted in FIG. 3A. For instance, in one embodiment, airflow passing through fan assembly 300 may pass through a stator(s) prior to entering fan 320. Similarly, in one embodiment, airflow passing through fan assembly 300 may pass through a stator(s) after exiting fan 330. Moreover, fan assembly 300 may include components other than those depicted in FIG. 3A.

Note that, the distance between fan 320 and stator 380 and/or the distance between stator 380 and fan 330 in FIG. 3A is by way of example only, for the distance between fan 320, fan 330, and stator 380 may be smaller or greater than that depicted in FIG. 3A. In fact, in at least one embodiment, stator 380 is incorporated into a finger guard of fan 320 and/or fan 330. Moreover, in one embodiment, fan assembly 300 includes a combination of one or more stand alone stators and one or more finger guard stators. In addition, in at least one embodiment, stator 380 is coupled to fan 320 and/or fan 330.

In at least one embodiment, assembly 300 includes a fewer number of fans than that depicted in FIG. 3A. For example, in at least one embodiment, assembly 300 does not include fan 320. In at least one of these embodiments, stator 380 introduces swirl onto the airflow whose direction of rotation is the opposite of the direction of the rotation of the blades of fan 330. As a result, in a preferred embodiment, airflow exiting fan 330 has only an axial component to its velocity. Moreover, in at least one embodiment, assembly 300 does not include fan 330. In at least one of these embodiments, stator 380 reduces (or preferably eliminates) swirl resulting from fan 320. As stated earlier, one advantage of the above described configurations is the increase in pressure resulting from the conversion of the kinetic energy associated with swirl into potential energy.

Figure 6:
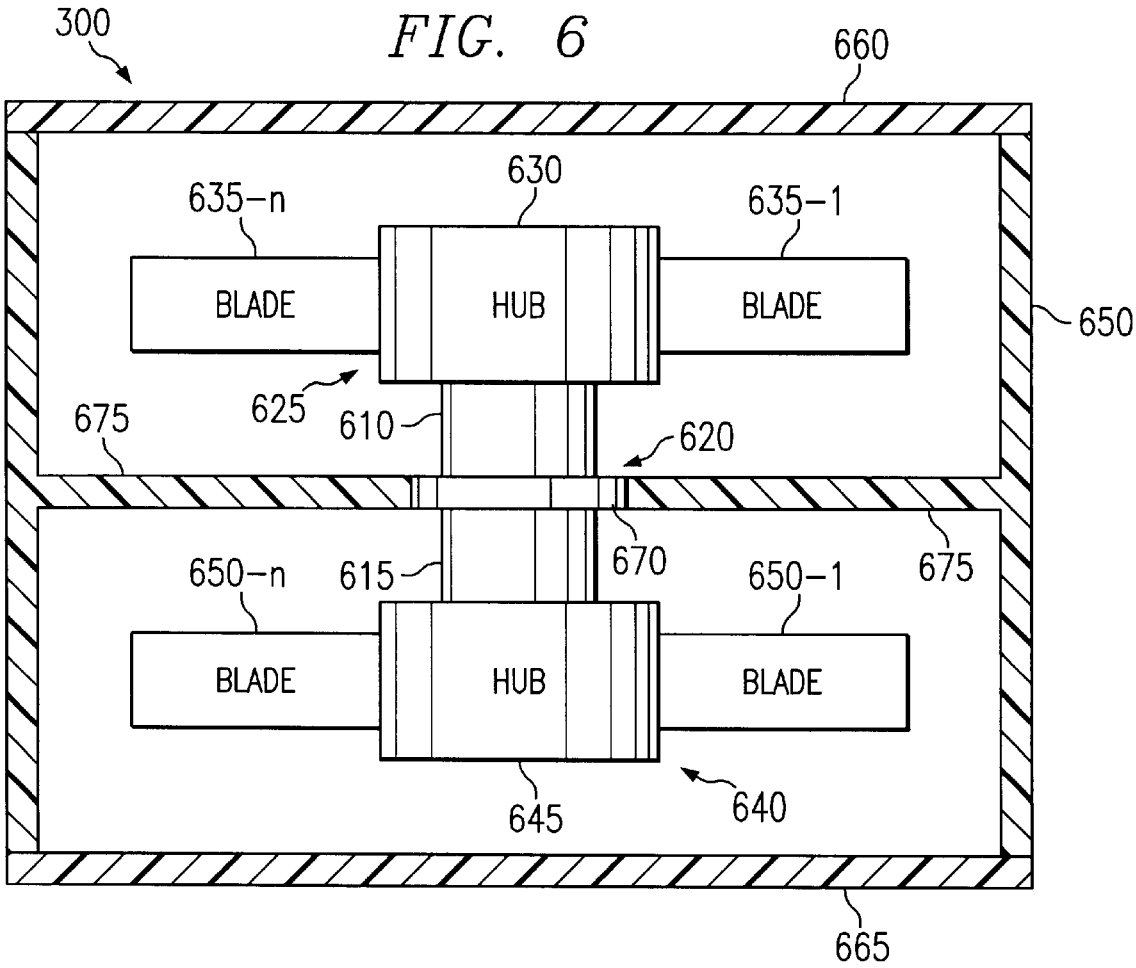
FIG. 6 depicts a second exemplary embodiment of an air moving assembly of the present invention.

In at least one embodiment, fan assembly 300 does not include a stator. FIG. 6 depicts such an embodiment. In the embodiment of FIG. 6, fan assembly 300 includes first motor assembly 610. Coupled to first motor assembly 610 in the embodiment of FIG. 6 is first impeller 625, which itself includes first hub 630 and one or more blades integrated therewith or attached thereto (represented by blades 635-1 and 635-n in FIG. 6). In the embodiment of FIG. 6, first motor assembly 610, and therefore, first impeller 625 coupled thereto, are coupled to strut assembly 620. In the embodiment of FIG. 6, strut assembly 620 includes struts 675. Struts 675 support a central location 670 to which motor assembly 610 and impeller 625 are mounted. Also mounted to central location 670 in the embodiment of FIG. 6 is second motor assembly 615. Preferably, coupled to second motor assembly 615 is second impeller 640, which itself includes second hub 645 and one or more blades integrated therewith or attached thereto (represented by blades 650-1 and 650-n) in FIG. 6. In the embodiment of FIG. 6, this conglomeration of first motor assembly 610, first impeller 625, strut assembly 620, second motor assembly 615, and second impeller 640 is disposed within, and preferably secured to, housing 650. Furthermore, in at least one embodiment, attached to or integrated with housing 650 is first finger guard 660 and second finger guard 665.

In the embodiment of FIG. 6, in order to compensate for any swirl resulting from first impeller 625, second impeller 640 may be rotated in a direction opposite to that of first impeller 625. Moreover, in such an embodiment, preferably, the dimensions and orientations of blades 650-1 and 650-n mirror those of blades 635-1 and 635-n so that the airflow resulting, at least in part, from second impeller 640 is in the same direction as the airflow resulting, at least in part, from first impeller 625.

The embodiment of fan assembly 300 depicted in FIG. 6 may have other configurations. For example, fan assembly 300 of FIG. 6 may include a fewer or greater number of components than that depicted in FIG. 6, as well as one or more components other than those depicted in FIG. 6. For instance, in at least one embodiment, first motor assembly 610 and second motor assembly 615 are coupled to different strut assemblies. Furthermore, in one embodiment, first motor assembly 610 and second motor assembly 615 may share electronics. Moreover, in one embodiment, first impeller 625 and second impeller 640 share a motor assembly. In addition, housing 650 may further include stationary venturi (not shown) having an inner surface that, in a known manner, typically resembles an airfoil rotationally symmetric about hub 630 and/or hub 645, which is closely spaced radially beyond the distal ends of rotating blades 635-1 and 635-n and/or blades 650-1 and 650-n. Furthermore blades 635-1 and 635-n and/or blades 650-1 and 650-n may include winglets as discussed earlier with respect to U.S. patent application Ser. No. 09/867,194. Furthermore, in at least one embodiment, rather than the counter rotation described above, the fan assembly of FIG. 6 may be configured such that first impeller 625 and second impeller 640 rotate in the same direction.

In at least one embodiment of fan assembly 300, integral electronics of the fan assembly may be designed such that if either first motor assembly 610 or second motor assembly 615 fails, the remaining functioning motor assembly speeds up the rotation of the impeller coupled thereto to compensate for the failed fan. Moreover, in one embodiment, the rotation of first impeller 625 and second impeller 640 is synchronized so to limit the number of acoustic beat frequencies.

In addition, the embodiment of fan assembly 300 depicted in FIG. 6 is not limited to configurations where no stators are present. In at least one embodiment, a stator (e.g., stator 380) is disposed between first impeller 625 and second impeller 640. Moreover, in at least one embodiment a stator (e.g., stator 380) is included as part of strut assembly 620 (e.g., part of struts 690 and/or central location 670). In at least one of these embodiments, first impeller 625 and second impeller 640 may rotate in the same direction. Moreover, in addition to or in lieu of a stator disposed between first impeller 625 and second impeller 640, fan assembly 300 may include one or more stators at other locations. For example, a stator may be attached to or integrated with first finger guard 660 and/or second finger guard 665. Moreover, a stator(s) not attached to, integrated with, or disposed within housing 650 may be present in the fan assembly.

In at least one embodiment, the above described air moving assemblies, or at least some of the components thereof, are employed in cooling applications for electronic devices.

Various embodiments of the present invention overcome the problems associated with the prior art. For instance, various embodiments of the present invention are capable of counteracting undesired swirl hampering the efficiency of prior art devices. In at least one embodiment of the present invention, since undesired swirl is counteracted, the desired pressure increase expected by the prior art is achieved, and, in some embodiments, surpassed. Morever, in at least one embodiment of the present invention, a desired pressure increase is achieved through the intentional impartation of what is considered in the art to be undesirable swirl.

Furthermore, certain losses experienced in prior art systems, such as expansion and contraction losses, are reduced (and in some instances, eliminated) in various embodiments of the present invention. In at least one embodiment, a stator has sufficient dimensions to at least reduce one expansion and/or one contraction between the stator and an air moving device. For example, in at least one embodiment, the annular area of a surface of the stator is the same as that of one or more of the other components (e.g., air moving devices) of the assembly.

Likewise, in various embodiments, the stator of embodiments the present invention may be inserted into or otherwise used with known air moving devices and/or assemblies to increase the performance of such devices and/or assemblies. For example, in one embodiment, the stator may be inserted between two fans of an N+1 series configuration to increase the performance of the configuration. As another example, in another embodiment, the stator may be used to effectively convert a less expensive tube axial fan into the relatively more expensive vane axial fan.

In addition, in at least one embodiment of the present invention, valuable device space is saved by the sharing of components between air moving devices (e.g., shared strut assembly, shared motor assembly, shared electronics, and/or shared housing). Therefore, cooling system designs and/or electronic device designs need not be compromised so as to accommodate certain air moving system configurations (e.g., N+1 configurations), as occurs in the prior art.

In at least one embodiment, the air moving assembly of the present invention helps compensate for the impedance resulting from a non-functioning fan (i.e., the failed fan state) by increasing the total pressure produced by embodiments of the fan assembly via stators and/or counter rotating fans.

In addition, in at least one embodiment, the rotation of the fans is synchronized so as to limit the number of acoustic beat frequencies.

What is claimed is:

1. An air moving assembly operable to generate a flow of air comprising:

an air moving device;

a stator; and another component;

wherein said stator is operable to at least reduce at least one event selected from the group consisting of one expansion and one contraction of airflow passing through said assembly;

wherein the annular area of a surface of said stator matches the annular area of a surface of said air moving device;

wherein the annular area of another surface of said stator matches the annular area of a surface of said another component; and wherein the annular area of said surface of said air moving device is different from the annular area of said surface of said another component.

2. The assembly of claim 1 wherein said stator is operable to at least reduce one expansion and one contraction of airflow passing through said assembly.

3. The assembly of claim 2 wherein said stator is operable to eliminate one expansion and one contraction of airflow passing through said assembly.

4. The assembly of claim 1 wherein said assembly further includes at least another air moving device.

5. The assembly of claim 1 wherein said stator is further operable to alter the rotational direction of swirl for airflow passing through said stator.

6. The assembly of claim 1 wherein said stator is further operable to impart swirl having a rotational direction opposite to that of a direction of rotation of an impeller of said air moving device.

7. The assembly of claim 1 wherein said stator comprises at least one curved blade.

8. The assembly of claim 1 wherein said stator comprises more blades than said air moving device.

9. The assembly of claim 1 wherein said stator is part of a fingerguard of said air moving device.

10. The assembly of claim 1 wherein said assembly is incorporated into an electronic device.

11. The assembly of claim 1 wherein said another component comprises an air duct.

12. An air moving device operable to generate a flow of air, said device comprising:

a strut assembly;

a first air moving assembly coupled to said strut assembly; and a second air moving assembly coupled to said strut assembly;

wherein said strut assembly includes a stator, said stator being operable to at least reduce at least one event selected from the group consisting of one expansion and one contraction of airflow passing through said air moving device; and wherein said first air moving assembly and said second air moving assembly are synchronized such that acoustic beat frequencies are limited.

13. The device of claim 12 wherein said stator is operable to at least reduce one expansion and one contraction of airflow passing through said air moving device.

14. A stator for improving the performance of an air moving system, said stator comprising:

a frame, said frame comprising an inner surface and an outer surface; and at least one blade coupled to said frame;

wherein said stator is operable to at least reduce at least one event selected from the group consisting of one expansion and one contraction of airflow passing through said cooling system; and wherein said inner surface has a tapered shape.

15. The stator of claim 14 wherein said stator is further operable to convert a tube axial fan to a vane axial fan.

16. An air moving device operable to generate a flow of air, said device comprising:

a strut assembly;

a first air moving assembly coupled to said strut assembly; and a second air moving assembly coupled to said strut assembly;

wherein said strut assembly includes a stator, said stator being operable to at least reduce at least one event selected from the group consisting of one expansion and one contraction of airflow passing through said air moving device; and wherein said device is operable such that when said first air moving assembly fails, the rotational velocity of an impeller of said second air moving assembly is increased.

17. A stator for improving the performance of an air moving system, said stator comprising:

a frame; and at least one blade coupled to said frame;

wherein said stator is operable to at least reduce at least one event selected from the group consisting of one expansion and one contraction of airflow passing through said cooling system; and wherein said stator comprises a drop-in module operable to be inserted between two air moving devices of an N+1 series configuration.

* * * * *